US011852423B2

(12) United States Patent
Rodrigues et al.

(10) Patent No.: US 11,852,423 B2
(45) Date of Patent: Dec. 26, 2023

(54) SYSTEMS AND METHODS FOR TUNABLE RADIATIVE COOLING

(71) Applicant: Toyota Motor Engineering & Manufacturing North America, Inc., Plano, TX (US)

(72) Inventors: Sean P. Rodrigues, Ann Arbor, MI (US); Ercan Mehmet Dede, Ann Arbor, MI (US); Paul Schmalenberg, Pittsburgh, PA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 431 days.

(21) Appl. No.: 17/166,770

(22) Filed: Feb. 3, 2021

(65) Prior Publication Data

US 2022/0244001 A1 Aug. 4, 2022

(51) Int. Cl.

| | |
|---|---|
| ***F28F 13/18*** | (2006.01) |
| ***F25B 23/00*** | (2006.01) |
| ***F28F 27/00*** | (2006.01) |

(52) U.S. Cl.

CPC ..... *F28F 13/185* (2013.01); *F25B 23/003* (2013.01); *F28F 27/00* (2013.01); *F28F 2245/06* (2013.01)

(58) Field of Classification Search

CPC . F25B 23/003; F28F 13/185; F28F 2013/008; F28F 2245/06; F28F 27/00

See application file for complete search history.

(56) References Cited

U.S. PATENT DOCUMENTS

| | | | | |
|---|---|---|---|---|
| 9,482,796 | B2 | 11/2016 | Arbabi et al. | |
| 9,798,218 | B2 * | 10/2017 | Ben-Abdallah | G02B 27/42 |
| 9,927,188 | B2 * | 3/2018 | Liu | F28F 13/18 |
| 10,060,686 | B2 | 8/2018 | Liu et al. | |
| 10,502,505 | B2 * | 12/2019 | Yang | F28F 13/18 |

(Continued)

FOREIGN PATENT DOCUMENTS

| | | | |
|---|---|---|---|
| EP | 1490601 | B1 | 8/2007 |
| KR | 20160147651 | A | 12/2016 |

(Continued)

OTHER PUBLICATIONS

Machine translation of WO 2014/148585, retrieved Jun. 2, 2023 (Year: 2023).*

(Continued)

*Primary Examiner* — Eric S Ruppert
*Assistant Examiner* — Hans R Weiland
(74) *Attorney, Agent, or Firm* — Dinsmore & Shohl LLP

(57) ABSTRACT

Embodiments described herein relate to a system with an electroactive substrate, a plurality of nanoparticles, and a control unit. The plurality of nanoparticles deposited in communication with the electroactive substrate. The control unit is configured to manipulate a shape of the electroactive substrate between an unactuated mode and an actuated mode to change an absorption band or an emission band of the plurality of nanoparticles. When the electroactive substrate shape is manipulated, the absorption band or the emission band of the plurality of nanoparticles is changed to tune the system for a radiative cooling based on a current dominating wavelength.

20 Claims, 6 Drawing Sheets

(56) References Cited

U.S. PATENT DOCUMENTS

| | | | | |
|---|---|---|---|---|
| 2019/0017758 | A1 | 1/2019 | Raman et al. | |
| 2020/0291888 | A1* | 9/2020 | Nojeh | F02G 1/04 |
| 2021/0123558 | A1* | 4/2021 | Leroy | F25B 27/007 |
| 2021/0131708 | A1* | 5/2021 | Dai | F25B 23/003 |

FOREIGN PATENT DOCUMENTS

| | | | | |
|---|---|---|---|---|
| WO | WO-2014148585 | A1 * | 9/2014 | H01M 10/613 |
| WO | 2019/118652 | A1 | 6/2019 | |
| WO | 2020/106660 | A2 | 5/2020 | |

OTHER PUBLICATIONS

Bao, Hua et al., "Double Layer Nanoparticle-Based Coatings for Efficient Terrestrial Radiative Cooling" Published in ScienceDirect, vol. 168, Aug. 2017, 3 pages, https://www.sciencedirect.com/science/article/abs/pii/S0927024817301836.

* cited by examiner

SYSTEMS AND METHODS FOR TUNABLE RADIATIVE COOLING

TECHNICAL FIELD

The present specification generally relates to radiative cooling, and more particularly, to electroactive substrates in communication with optical metamaterials that permit for tunable radiative cooling.

BACKGROUND

Passive radiative cooling is known for improving energy efficiencies by providing a path to dissipate heat from a structure into an atmosphere. Further, it is known to use nocturnal radiative cooling via pigmented paints, dielectric coating layers, metallized polymer films, and organic gases because of their intrinsic thermal emission properties. Additionally, daytime radiative cooling is known by absorbing visible wavelengths, though nanostructures or hybrid optical metamaterials. However, these are static radiative cooling layers and are not tunable between different modes based on nocturnal or daytime radiative dominant wavelengths and cooling requirements.

SUMMARY

In one embodiment, a system with an electroactive substrate, a plurality of nanoparticles, and a control unit is provided. The plurality of nanoparticles deposited in communication with the electroactive substrate. The control unit is configured to manipulate a shape of the electroactive substrate between an unactuated mode and an actuated mode to change an absorption band or an emission band of the plurality of nanoparticles. When the electroactive substrate shape is manipulated, the absorption band or the emission band of the plurality of nanoparticles is changed to tune the system for a radiative cooling based on a current dominating wavelength.

In another embodiment, a method of controlling an optical metamaterials system is provided. The method includes determining, by a control unit, a periodicity of a plurality of nanoparticles deposited in communication with an electroactive substrate, determining, by the control unit, whether a radiative cooling is required, and manipulating, via an electric source, a shape of the electroactive substrate between an unactuated mode and an actuated mode to tune the optical metamaterials system for radiative cooling. The manipulating of the shape of the electroactive substrate changes the periodicity of the plurality of nanoparticles to change an absorption band or an emission band of the plurality of nanoparticles.

In yet another embodiment, an optical metamaterials system is provided. The system includes an electroactive substrate, a plurality of unit cells, an electric source, and a control unit is provided. The electroactive substrate has an upper surface and an inner surface. The upper surface of the electroactive substrate is planar. The plurality of unit cells are positioned in communication with the electroactive substrate. Each unit cell of the plurality of unit cells has at least one nanoparticle deposit of a plurality of nanoparticles. The electric source is communicatively coupled to the electroactive substrate. The control unit is configured to control the electric source to supply a voltage or a current to manipulate a shape of the electroactive substrate between an unactuated mode and an actuated mode to change an absorption band or an emission band of the plurality of nanoparticles. In the actuated mode, the electric source supplies a current to the electroactive substrate to expand the electroactive substrate for each unit cell of the plurality of unit cells to cause a shift in optical properties of the plurality of nanoparticles towards an infrared spectrum. In the unactuated mode, the electric source reduces the current supplied to the electroactive substrate to contract the electroactive substrate for each unit cell of the plurality of unit cells to cause the shift in optical properties of the plurality of nanoparticles towards an ultraviolet spectrum.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to an optical metamaterials system that include assemblies with a substrate that is electroactive and a plurality of nanoparticles in physical communication with the substrate. The substrate is configured to have its shape manipulated to change an absorption band or an emission band of the plurality of nanoparticles. As a non-limiting example, the substrate is manipulated between an unactuated mode or state and an actuated mode or state, and a plurality of modes or states therebetween based on a dominating wavelength of the current time of day. As such, the substrate is manipulated, via an electric source, to change the absorption band or the emission band of the plurality of nanoparticles to tune the optical metamaterials system for radiative cooling based on a presently dominating wavelength. As such, the shape changes of the electroactive substrate generates or causes a resonance shift of the optical properties of the plurality of nanoparticles of the optical metamaterials system towards an infrared spectrum or towards an ultraviolet spectrum.

Further, in the nighttime heat mode, the electric source supplies a current to the electroactive substrate to expand the shape of the electroactive substrate for each unit cell of the plurality of unit cells to generate or cause a resonance shift in optical properties of the plurality of nanoparticles towards the infrared spectrum. In the daytime heat mode, the electric source reduces the current supplied to the electroactive substrate to contract the shape of the electroactive substrate for each unit cell of the plurality of unit cells to generate or cause a resonance shift in the optical properties of the plurality of nanoparticles towards the ultraviolet spectrum.

Various embodiments of optical metamaterials system to tune radiative cooling are described in detail herein.

As used herein, the term "communicatively coupled" may mean that coupled components are capable of providing electrical signals and/or exchanging data signals with one another such as, for example, electrical signals via conductive medium or a non-conductive medium, though networks such as via Wi-Fi, Bluetooth, and the like, electromagnetic signals via air, optical signals via optical waveguides, and the like.

Figure 1:
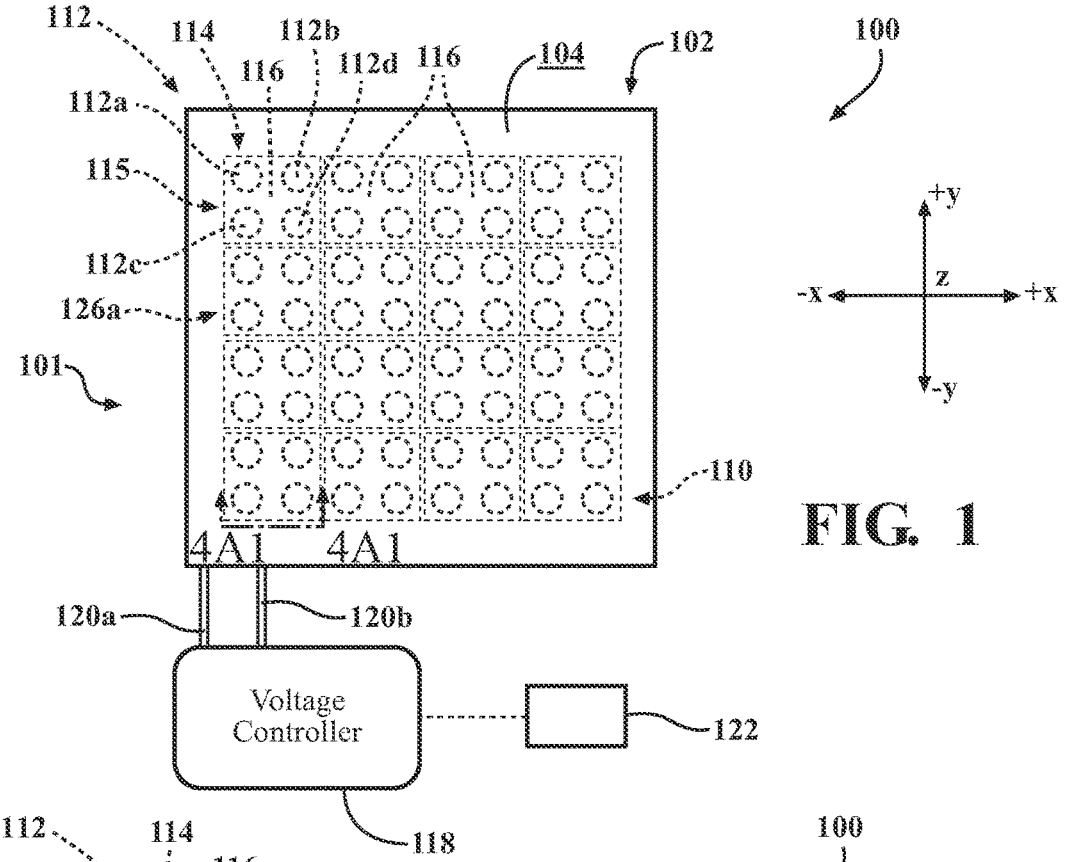
FIG. 1 schematically depicts a top down view of a first example optical metamaterials system in a daytime heat mode according to one or more embodiments shown and described herein.

As used herein, the term "system lateral direction" refers to the forward-rearward direction of the system (i.e., in a +/−Y direction of the coordinate axes depicted in FIG. 1). The term "system longitudinal direction" refers to the cross-direction (i.e., along the X axis of the coordinate axes depicted in FIG. 1), and is transverse to the lateral direction. The term "system vertical direction" refers to the upward-downward direction of the system (i.e., in the +/−Z direction of the coordinate axes depicted in FIG. 1). As used herein, "upper" is defined as generally being towards the positive Z direction of the coordinate axes shown in the drawings. "Lower" or "below" is defined as generally being towards the negative Z direction of the coordinate axes shown in the drawings.

Referring now to FIGS. 1-5, an example optical metamaterials system 100 is schematically illustrated. The example optical metamaterials system 100 includes an example radiative cooling assembly 101, an electric source 118 and a control unit 122. The radiative cooling assembly 101 includes a substrate 102. In some embodiments, the substrate 102 is electroactive such that upon the introduction of electricity, such as a current or voltage, via the electric source 118, the shape of the substrate 102 changes. In some embodiments, the substrate 102 includes an upper surface 104 and an opposite inner surface 106 that defines a thickness T1. In some embodiments, the inner surface 106 is in contact with other objects or materials, such as windshield of a vehicle, an object that is moved upon an actuation of the substrate 102, and the like, as discussed in greater detail herein. In other embodiments, the substrate 102 includes a plurality of layers to form the substrate 102. For example, the substrate 102 may be formed using several layers such as those formed by three-dimensional printing techniques. In other embodiments, the thickness T1 of the substrate 102 includes a cavity. That is, the substrate 102 is hollow and may contain a fluid such as a liquid or a gas.

In some embodiments, the upper surface 104 and the inner surface 106 of the substrate 102 are each substantially planar. In other embodiments, the upper surface 104 and the inner surface 106 of the substrate 102 may be other shapes, such as have arcuate or curvilinear portions that extend from the surfaces 104, 106 in the system vertical direction (i.e., in the +/−Z direction), crevasses the extend into the surfaces 104, 106 in the system vertical direction (i.e., in the +/−Z direction), and the like.

Figure 3:
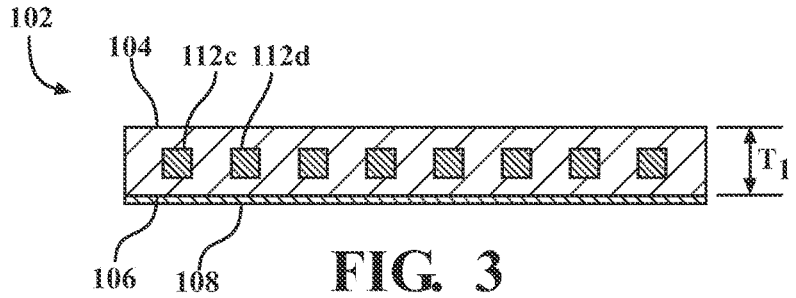
FIG. 3 schematically depicts an isolated cross-sectional view of the first example optical metamaterials system of FIG. 2 taken from line 3-3 according to one or more embodiments shown and described herein.

In some embodiments, the substrate 102 may be transparent such that visible light, infrared radiation, and the like, may pass through the substrate 102 from the upper surface 104 to the inner surface 106. In other embodiments, the substrate 102 may be opaque such that visible light, infrared radiation, and the like, may not pass through the substrate 102. In yet other embodiments, as best shown in FIG. 3, the inner surface 106 of the substrate 102 includes an opaque layer 108, such as a backing, a film, and the like, that may be coupled to the inner surface 106 via an adhesive, a hook and look type fastener, and the like. The opaque layer 108 prevents visible light, infrared radiation, and the like, from passing through the substrate 102 beyond the inner surface 106.

In some embodiments, the substrate 102 is a polymer that is electroactive. As such, upon an excitation voltage, current or power, the polymer component of the substrate 102 changes the shape of the substrate 102. Example polymers include polydimethylsiloxane (PDMS), piezoelectric polymers, electrostrictive polymers, dielectric elastomers, liquid crystal elastomers, ferroelectric polymers, and the like.

In some embodiments, the substrate 102 may expand/contract in the system longitudinal direction (i.e., in the +/−X direction). In other embodiments, the substrate 102 may expand/contract in the system lateral direction (i.e., in the +/−Y direction). In other embodiments, the substrate 102 may expand/contract in the system vertical direction (i.e., in the +/−Z direction). In yet other embodiments, the substrate 102 may expand/contract in any combination of the above mentioned system directions.

Still referring to FIGS. 1-5, in the first example optical metamaterials system 100, an optically active array 110 is embedded within the substrate 102. It should be understood that the optically active array 210 is deposited or embedded to be in physical communication with the substrate 102. The optically active array 110 is embedded below the upper surface 104 in the system vertical direction (i.e., in the +/−Z direction). Further, the optically active array 110 is positioned such that ambient wavelengths surrounding the radiative cooling assembly 101 enter the upper surface 104 and then the optically active array 110. As such, the optically active array 110 is positioned between the upper surface 104 and the inner surface 106 and is orientated in a direction opposite of the inner surface 106. The optically active array 110 is repeating within the substrate 102. In some embodiments, the optically active array 110 is repeated in a periodic, or in a uniform pattern. In other embodiments, the optically active array 110 is repeated in an aperiodic, or in a non-uniform or irregular pattern or sequence (e.g., random). Further, the optically active array 110 may be deposited into a plurality of independent uniform patterns, into a plurality of independent non-uniform patterns, combinations thereof, and the like.

The illustrated example optically active array 110 includes an array 115 of a plurality of nanoparticles 112 or resonators positioned within an individual unit cell 116 that forms a plurality of unit cells 114. Example particles of the plurality of nanoparticles 112 or resonators include metals, such as gold, semiconductors, or ceramics, such as titanium nitrate. As such, the nanoparticles may be a metamaterial. In some embodiments, the array 115 is periodic or uniform. In other embodiments, the array 115 is aperiodic, or non-uniform. In other embodiments, the array 115 is a combination of periodic and aperiodic patterns. Further, in some embodiments, the plurality of nanoparticles 112 or resonators may be a plurality of regular or irregular shapes. As such, it should be appreciated that while the plurality of nanoparticles 112 or resonators are illustrated as being spherical in FIGS. 1-3, this is non-limiting and the plurality of nanoparticles 112 or resonators may be cylindrical, rectangular, square, hexagonal, and the like.

The array 115 of the plurality of nanoparticles 112 or resonators is configured to plasmonically absorb and emit infrared (IR) radiation. As such, the absorption/emission band of the optically active array 110 is dictated, at least in part, by the periodicity of the plurality of nanoparticles 112 or resonators. As such, as the periodicity of the optically active array 110 is altered by expansion/contraction of the substrate 102, tuning of the absorption/emission band is permitted, as discussed in greater detail herein. The array 115 of the plurality of nanoparticles 112 or resonators is effective to absorb and re-emit locally originated IR radiation.

Still referring to FIGS. 1-5, the example particles of the plurality of nanoparticles 112 or resonators may be contained in the individual unit cell 116, forming a plurality of unit cells 114. That is, at least one nanoparticle of the plurality of nanoparticles 112 or resonators of the optically active array 110 may be contained in its own unit cell 116. It should be appreciated that, in some embodiments, the unit cell 116 includes only a single particle of the plurality of nanoparticles 112 or resonators. In other embodiments, the unit cell 116 includes more than one particle of the plurality of nanoparticles 112 or resonators. Illustrations of the current embodiments, illustrate that each unit cell 116 includes four nanoparticle deposits 112*a*-112*d* of the plurality of nanoparticles 112. The illustrations of four particles of the plurality of nanoparticles 112 or resonators per unit cell 116 are merely examples and is thus non-limiting.

Figure 4A:
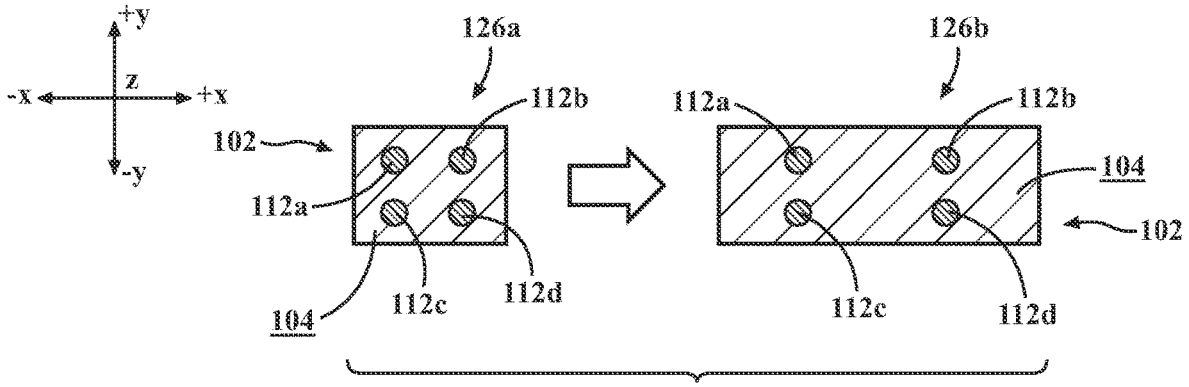
FIG. 4A schematically depicts an isolated cross-sectional view along a planar axis of the first example unit cell in the daytime heat mode of the first example optical metamaterials system of FIG. 1 taken from line 4A1-4A1 and the first example unit cell in the nighttime heat mode of the first example optical metamaterials system of FIG. 2 taken from line 4A2-4A2 according to one or more embodiments shown and described herein.
Figure 4B:
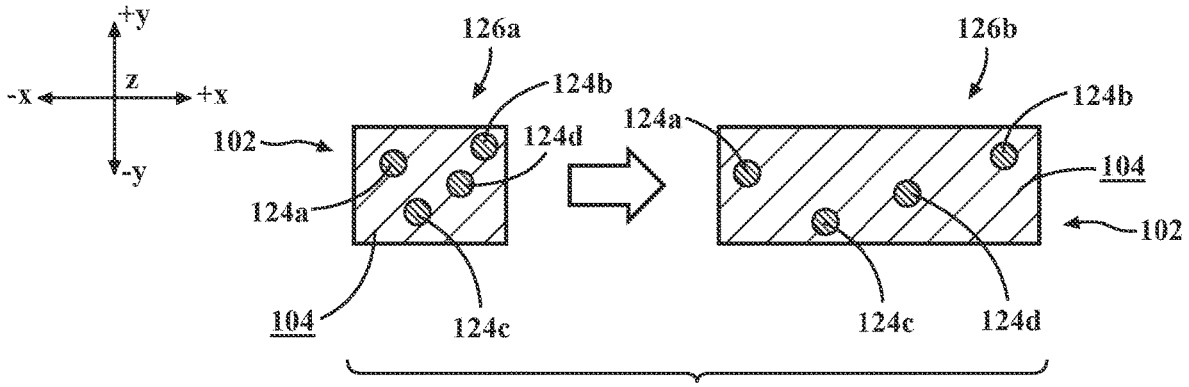
FIG. 4B schematically depicts an isolated cross-sectional view along a planar axis of a second example unit cell of the first example optical metamaterials system of FIG. 4A in the daytime heat mode and the nighttime heat mode according to one or more embodiments shown and described herein.

It should also be appreciated that, in some embodiments, the plurality of unit cells 114 that include the plurality of nanoparticles 112 are periodic to form a uniform pattern of the optically active array 110, as best illustrated in FIG. 4A. As such, in these embodiments, the pattern of the plurality of unit cells 114 and the plurality of nanoparticles 112 are periodic, or positioned in a uniform pattern. In other embodiments, the plurality of unit cells 114 and/or the plurality of nanoparticles 112 are aperiodic, or in a random sequence or non-uniform pattern, as best illustrated in FIG. 4B.

The optically active array 110 may be embedded between the upper surface 104 and the inner surface 106 of the substrate 102 via lithography. In some embodiments, the lithography is an electron beam lithography. In other embodiments, the lithography is a photolithography, an optical lithography, a UV lithography, and/or the like.

It is understood that the unit cell 116 is one of a plurality of unit cells 114, or meta atoms, that are spaced apart or distanced from the adjacent unit cells 114 of the plurality of unit cells 114. In some embodiments, each unit cell 116 of the plurality of unit cells 114 adjacent to one another are spaced apart or distanced from one another in the system longitudinal direction (i.e., in the +/−X direction). In other embodiments, each unit cell 116 of the plurality of unit cells 114 adjacent to one another are gapped or distanced from one another in the system lateral direction (i.e., in the +/−Y direction). In other embodiments, each unit cell 116 of the plurality of unit cells 114 adjacent to one another are spaced apart or distanced from one another in both the system longitudinal direction (i.e., in the +/−X direction) and in the system lateral direction (i.e., in the +/−Y direction).

Still referring to FIG. 1-5, the gap or distance between each unit cell 116 of the plurality of unit cells 114 are to allow for pitch changes of each unit cell 116 of the plurality of unit cells 114. That is, the space formed from the gap permits moving and pitching of each unit cell 116 of the plurality of unit cells 114 based on the contraction and expansion of the substrate 102, as discussed in greater detail herein. As such, the movement or pitch of each unit cell 116 of the plurality of unit cells 114 permits the first example optical metamaterials system 100 to tune the radiative cooling by absorbing and reemitting locally originated IR radiation, as discussed in greater detail herein. That is, the movement or pitch of each unit cell 116 of the plurality of unit cells 114 caused from the movement of the substrate 102 permits the first example optical metamaterials system 100 to adjust between changing wavelengths such that the radiative cooling is dynamic.

For example, in some embodiments, the first example optical metamaterials system 100 may generate or cause a resonance shift in response to the current wavelengths towards the ultraviolet spectrum or towards the infrared spectrum for radiative cooling, as discussed in greater detail herein. As such, because the wavelengths of optical radiation vary during the daytime and nighttime, the first example optical metamaterials system 100 is tuned by moving or changing the pitch of each unit cell 116 of the plurality of unit cells 114 via the movement of the substrate 102, as discussed in greater detail herein.

Figure 2:
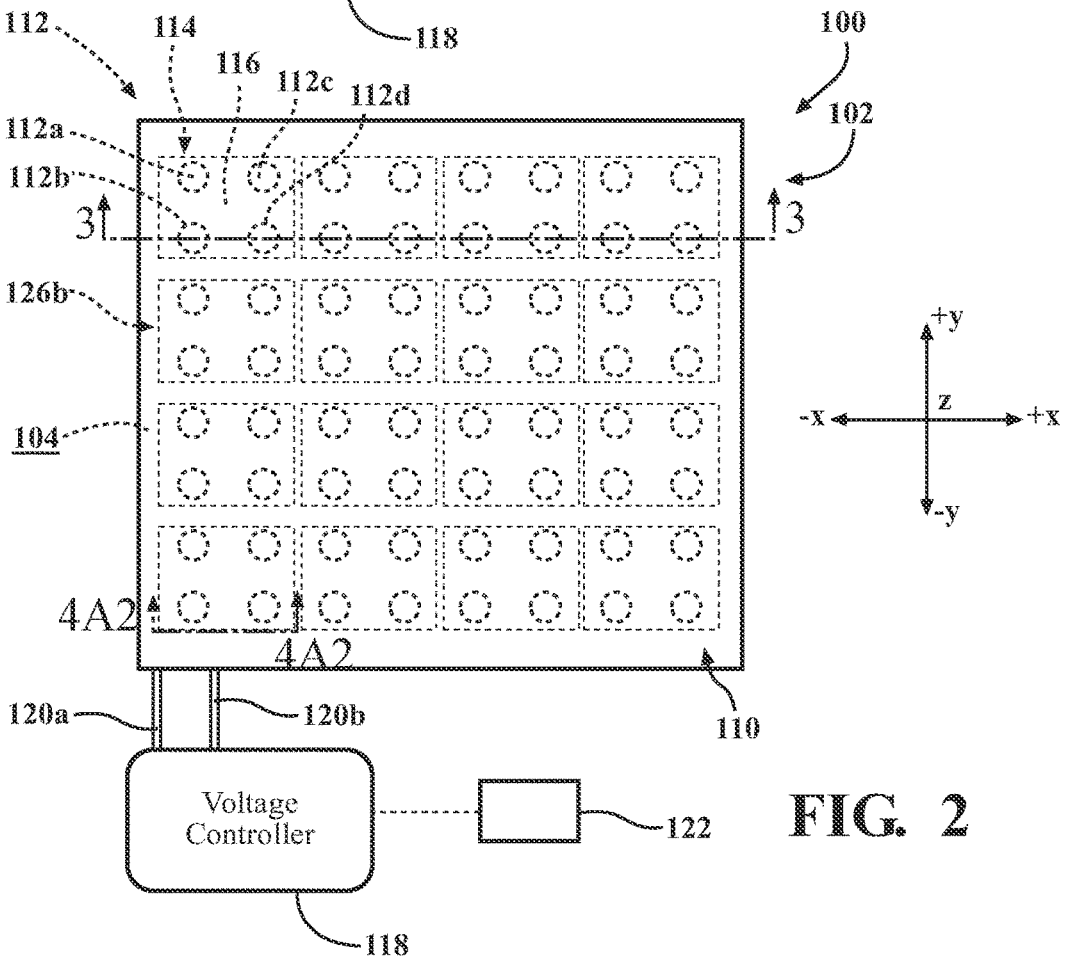
FIG. 2 schematically depicts a top down view of the first optical metamaterials system of FIG. 1 in a nighttime heat mode according to one or more embodiments shown and described herein.

Referring now to FIGS. 1-2, the electric source 118 of the example optical metamaterials system 100 is communicatively coupled to the substrate 102 via a pair of electrical conductors or electrodes 120*a*, 120*b*. That is, the electric source 118 of the example optical metamaterials system 100 is electrically in communication with the substrate 102 via the pair of electrical conductors or electrodes 120*a*, 120*b*. The pair of electrodes 120*a*, 120*b* may be positioned at varying positions along the substrate 102. It should also be appreciated that each additional substrate 102 with the example optical metamaterials system 100 may have at least one pair of electrodes 120*a*, 120*b* that are communicatively coupled to the electric source 118. The electric source 118 is configured to generate a voltage or a current to the substrate 102 via the pair of electrodes 120*a*. 120*b*. In response to the supplied voltage or current, the substrate 102 may actuate, or expand, or may contract, or move to an unactuated state or position. That is, upon an excitation, the substrate 102 may expand in the system longitudinal direction (i.e., in the +/−X direction), the system lateral direction (i.e., in the +/−Y direction), the system vertical direction (i.e., in the +/−Z direction), and combinations thereof, as best illustrated in FIG. 2. Conversely, under less excitation when compared to the excitation required to expand the substrate 102, or without excitation, the substrate 102 may contract in the system longitudinal direction (i.e., in the +/−X direction), the system lateral direction (i.e., in the +/−Y direction), the system vertical direction (i.e., in the +/−Z direction), and combinations thereof, as best illustrated in FIG. 1, into an unactuated state, or a home position.

It should be understood that the periodicity of the example optical metamaterials system 100 is altered by the expansion and/or contraction of the substrate 102, thereby enabling tuning of the absorption and/or emission band. As such, the altering of the substrate 102 by the expansion and/or contraction of the substrate 102 changes or tunes the example optical metamaterials system 100 between an unactuated or daytime heat mode and an actuated or nighttime heat mode, as discussed in greater detail herein. Further, it should be appreciated that there may be a plurality of differing transitions between the unactuated or daytime heat mode and the actuated or nighttime heat mode. As such, the terms unactuated or daytime heat mode and an actuated or nighttime heat mode may not be absolute values but may be transitions between complete transformations.

Still referring to FIGS. 1-2, the control unit 122 is configured to determine the required mode (e.g., the unactuated or the daytime heat mode, the actuated or nighttime heat mode, and/or somewhere in between) to maximize the radiative heat cooling. Once determined, the control unit 122 controls the electric source 118 to provide each substrate 102 within the example optical metamaterials system 100 with the excitation voltage, current, power, and the like. As such, the control unit 122 may be connected to a storage medium via Wi-Fi, Bluetooth®, and the like, to access the predetermined excitation voltage, current, power, and the like. Further, the control unit 122 may include a processor and memory components, either volatile or non-volatile, which is capable of reading, storing and/or executing machine and/or program instructions. As such, in some embodiments, the control unit 122 may function as a central processing unit (CPU). Further in some embodiments, a sensor, such as a photo diode, may be coupled to the control unit 122 to detect or measure ambient light conditions.

Now referring to FIG. 4A, a first example unit cell 126*a* and a second example unit cell 126*b* of the plurality of unit cells 114 of the radiative cooling assembly 101 is schematically detected. It should be understood that FIG. 4A is an isolated cross section view of the first example unit cell 126*a* and the second example unit cell 126*b* of FIGS. 1-2 taken from lines 4A1-4A1 and 4A2-4A2, respectively, and viewed along a planar axis below the upper surface 104 of the substrate 102 in the system lateral direction (i.e., in the +/−Y direction). As such, it should be understood that the first example unit cell 126*a* is illustrated as being in the daytime heat mode of FIG. 1 and the second example unit cell 126*b* is illustrated as being in the nighttime heat mode of FIG. 2, as discussed in greater detail herein.

In the illustrated embodiment, the first and second example unit cells 126*a*, 126*b* includes four example nanoparticle deposits 112*a*-112*d*. Further, it should be appreciated that the example nanoparticle deposits 112*a*-112*d* are positioned in a periodic pattern. That is, the example nanoparticle deposits 112*a*-112*d* are uniformly positioned within the example unit cells 126*a*, 126*b*. In some embodiments, the example nanoparticle deposits 124*a*-124*d* are illustrated as being spherical in shape. This is non-limiting and the example nanoparticle deposits 112*a*-112*d* may be any shape, such as cylindrical, rectangular, square, hexagonal, and the like. Further the example nanoparticle deposits 124*a*-124*d* may be any regular or irregular shape. Additionally, the example nanoparticle deposits 112*a*-112*d* may be any size, positioned anywhere in the substrate 102, and the like.

Still referring to FIG. 4A, it should be understood that the spacing or gaps between the adjacent example nanoparticle deposits 112*a*-112*d* are smaller in the first example unit cell 126*a* than when the adjacent example nanoparticle deposits 112*a*-112*d* are in the second example unit cell 126*b*. That is, in the daytime heat mode, the example nanoparticle deposits 112*a*-112*d* of the first example unit cell 126*a* are spaced closer together when compared to the example nanoparticle deposits 112*a*-112*d* in the nighttime heat mode of the second example unit cell 126*b*. It should be understood that in the nighttime heat mode, the second example unit cell 126*b* is expanded or stretched and the example nanoparticle deposits 112*a*-112*d* are shifted to such that the distance from one another is greater.

It should be appreciated that, in some embodiments, in the nighttime heat mode, the second example unit cell 126*b* is expanded or stretched in the system longitudinal direction (i.e., in the +/−X direction). As such, the example nanoparticle deposits 112*a*-112*d* are shifted or moved in the system longitudinal direction (i.e., in the +/−X direction). In other embodiments, in the nighttime heat mode, the second example unit cell 126*b* is expanded or stretched in the system lateral direction (i.e., in the +/−Y direction) and the example nanoparticle deposits 112*a*-112*d* are shifted or moved in the system lateral direction (i.e., in the +/−Y direction). It should be understood that, in some embodiments, the second example unit cell 126*b* may be expanded or stretched in combinations of the system lateral direction (i.e., in the +/−Y direction) and the system longitudinal direction (i.e., in the +/−X direction). Further, in some embodiments, the example nanoparticle deposits 112*a*-112*d* may be shifted in combinations of the system lateral direction (i.e., in the +/−Y direction) and the system longitudinal direction (i.e., in the +/−X direction). It should be understood that the example nanoparticle deposits 112*a*-112*d* are not limited to shifting, and instead and/or in combination with the shifting, may pivot, move, change orientation, and the like. It should also be appreciated that in some embodiments, the second example unit cell 126*b* may be expanded or stretched, but the example nanoparticle deposits 112*a*-112*d* do not move, shift, or change an orientation, as discussed in greater detail herein with reference to FIG. 5.

That is, the example nanoparticle deposits 112*a*-112*d* are stationary regardless of movement of the substrate 102.

In contrast, when changing from the nighttime heat mode to the daytime heat mode, the first example unit cell 126*a* is contracted in the system longitudinal direction (i.e., in the +/−X direction), in the system lateral direction (i.e., in the +/−Y direction), and/or in combinations thereof. As such, the example nanoparticle deposits 112*a*-112*d* are shifted or moved in the system longitudinal direction (i.e., in the +/−X direction) in the system lateral direction (i.e., in the +/−Y direction), and/or in combinations thereof such that the example nanoparticle deposits 112*a*-112*d* are shifted or moved to be closer in distance to one another than the distance of the example nanoparticle deposits 112*a*-112*d* are shifted or moved in the second example unit cell 126*b*. It should be understood that the example nanoparticle deposits 112*a*-112*d* are not limited to shifting, and instead and/or in combination with the shifting, may pivot, move, change orientation, and the like. It should also be appreciated that in some embodiments, the first example unit cell 126*a* may be contracted or positioned in a home position or unexpanded state, but the example nanoparticle deposits 112*a*-112*d* do not move, shift, or change an orientation. That is, the example nanoparticle deposits 112*a*-112*d* are stationary regardless of movement of the substrate 102.

Now referring to FIG. 4B, second aspect of the first example unit cell 126*a* and the second example unit cell 126*b* of the plurality of unit cells 114 of the radiative cooling assembly 101 is schematically detected. It should be understood that FIG. 4B is an isolated cross section view of a second aspect of the first example unit cell 126*a* and the second example unit cell 126*b* of FIGS. 1-2 view along a planar axis below the upper surface 104 of the substrate 102 in the system lateral direction (i.e., in the +/−Y direction). As such, it should be understood that the first example unit cell 126*a* is illustrated as being in the daytime heat mode of FIG. 1 and the second example unit cell 126*b* is illustrated as being in the nighttime heat mode of FIG. 2, as discussed in greater detail herein.

In the illustrated embodiment, the first and second example unit cells 126*a*. 126*b* includes four example nanoparticle deposits 124*a*-124*d*. It should be understood that the four example nanoparticle deposits 124*a*-124*d* of FIG. 4B are identical to the four example nanoparticle deposits 112*a*-112*d* of FIG. 4A except as otherwise described herein with respect to FIG. 4B. Additionally, it should be understood that the first and second example unit cells 126*a*, 126*b* of FIG. 4B are identical to the first and second example unit cells 126*a*. 126*b* of FIG. 4A except as otherwise described herein with respect to FIG. 4B.

As illustrated, it should be appreciated that the example nanoparticle deposits 124*a*-124*d* are positioned in an aperiodic pattern. That is, the example nanoparticle deposits 124*a*-124*d* are randomly positioned within the example unit cells 126*a*, 126*b*. In some embodiments, the example nanoparticle deposits 124*a*-124*d* are illustrated as being spherical in shape. This is non-limiting and the example nanoparticle deposits 124*a*-124*d* may be any shape, such as cylindrical, rectangular, square, hexagonal, and the like. Further the example nanoparticle deposits 124*a*-124*d* may be any regular or irregular shape. Additionally, the example nanoparticle deposits 124*a*-124*d* may be any size, positioned anywhere in the substrate 102, and the like.

Still referring to FIG. 4B, it should be understood that the spacing or gaps between the adjacent example nanoparticle deposits 124*a*-124*d* are smaller in the first example unit cell 126*a* than when the adjacent example nanoparticle deposits 124*a*-124*d* are in the second example unit cell 126*b*. That is, in the daytime heat mode, the example nanoparticle deposits 124*a*-124*d* of the first example unit cell 126*a* are spaced closer together when compared to the example nanoparticle deposits 124*a*-124*d* in the nighttime heat mode of the second example unit cell 126*b*. It should be understood that in the nighttime heat mode, the second example unit cell 126*b* is expanded or stretched and the example nanoparticle deposits 124*a*-124*d* are shifted to such that the distance from one another is greater.

It should be appreciated that, in some embodiments, in the nighttime heat mode, the second example unit cell 126*b* is expanded or stretched in the system longitudinal direction (i.e., in the +/−X direction). As such, the example nanoparticle deposits 124*a*-124*d* are shifted or moved in the system longitudinal direction (i.e., in the +/−X direction). In other embodiments, in the nighttime heat mode, the second example unit cell 126*b* is expanded or stretched in the system lateral direction (i.e., in the +/−Y direction) and the example nanoparticle deposits 124*a*-124*d* are shifted or moved in the system lateral direction (i.e., in the +/−Y direction). It should be understood that, in some embodiments, the second example unit cell 126*b* may be expanded or stretched in combinations of the system lateral direction (i.e., in the +/−Y direction) and the system longitudinal direction (i.e., in the +/−X direction). Further, in some embodiments, the example nanoparticle deposits 124*a*-124*d* may be shifted in combinations of the system lateral direction (i.e., in the +/−Y direction) and the system longitudinal direction (i.e., in the +/−X direction). It should be understood that the example nanoparticle deposits 124*a*-124*d* are not limited to shifting, and instead and/or in combination with the shifting, may pivot, move, change orientation, and the like. It should also be appreciated that in some embodiments, the second example unit cell 126*b* may be expanded or stretched, but the example nanoparticle deposits 124*a*-124*d* do not move, shift, or change an orientation, as discussed in greater detail herein with reference to FIG. 5. That is, the example nanoparticle deposits 124*a*-124*d* are stationary regardless of movement of the substrate 102.

In contrast, when changing from the nighttime heat mode to the daytime heat mode, the first example unit cell 126*a* is contracted in the system longitudinal direction (i.e., in the +/−X direction), in the system lateral direction (i.e., in the +/−Y direction), and/or in combinations thereof. As such, the example nanoparticle deposits 124*a*-124*d* are shifted or moved in the system longitudinal direction (i.e., in the +/−X direction) in the system lateral direction (i.e., in the +/−Y direction), and/or in combinations thereof such that the example nanoparticle deposits 124*a*-124*d* are shifted or moved to be closer in distance to one another than the distance of the example nanoparticle deposits 124*a*-124*d* are shifted or moved in the second example unit cell 126*b*. It should be understood that the example nanoparticle deposits 124*a*-124*d* are not limited to shifting, and instead and/or in combination with the shifting, may pivot, move, change orientation, and the like. It should also be appreciated that in some embodiments, the first example unit cell 126*a* may be contracted or positioned in the home position, but the example nanoparticle deposits 124*a*-124*d* do not move, shift, or change an orientation.

Figure 5:
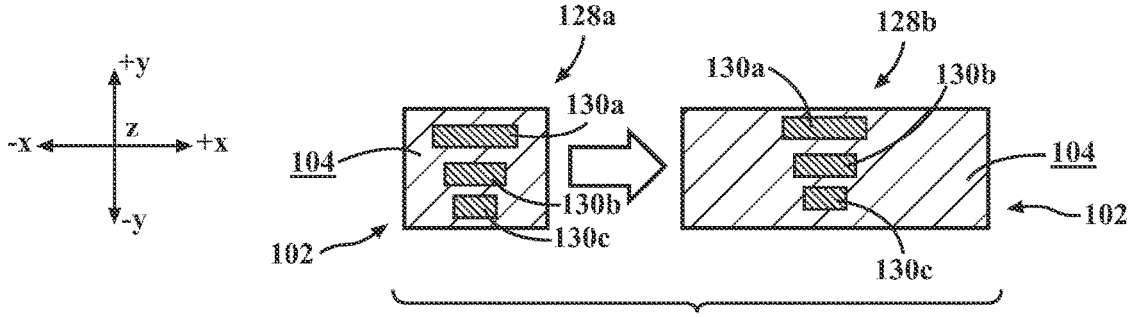
FIG. 5 schematically depicts an isolated cross-sectional view along a planar axis of a third example unit cell of the first example optical metamaterials system of FIGS. 1 and 2 in a daytime heat mode and a nighttime heat mode according to one or more embodiments shown and described herein.

Now referring to FIG. 5, a third example unit cell 128*a* and a fourth example unit cell 128*b* of the plurality of unit cells 114 of the radiative cooling assembly 101 is schematically detected. It should be understood that the a third example unit cell 128*a* and a fourth example unit cell 128*b* are similar cross sectional views without the upper surface 104 of the substrate 102 and viewed along a planar axis in the system lateral direction (i.e., in the +/−Y direction). It should also be understood that the third example unit cell 128*a* is illustrated as being in the daytime heat mode and the fourth example unit cell 128*b* is illustrated as being in the nighttime heat mode, as discussed in greater detail herein.

In the illustrated embodiment, the third and fourth example unit cells 128*a*, 128*b* includes three example nanoparticle deposits 130*a*-130*c*. Further, it should be appreciated that the example nanoparticle deposits 130*a*-130*c* are positioned in a periodic pattern. That is, the example nanoparticle deposits 130*a*-130*c* are sequential or uniformly positioned within the third and fourth example unit cells 128*a*, 128*b*. In some embodiments, the example nanoparticle deposits 130*a*-130*c* are illustrated as being rectangular with varying lengths. This is non-limiting and the example nanoparticle deposits 130*a*-130*c* may be any shape, such as an octagon, square, hexagonal, and the like. Further, the example nanoparticle deposits 130*a*-130*c* may be any regular or irregular shape. Additionally, the example nanoparticle deposits 130*a*-130*c* may have uniform or varying lengths, widths, and the like. It should be understood that the size and shape of the example nanoparticle deposits 130*a*-130*c* may influence or provide for broadband absorption emission qualities.

Still referring to FIG. 5, it should be understood that the spacing or gaps between the adjacent example nanoparticle deposits 130*a*-130*c* are equal whether or not the units cells are in the daytime heat mode (e.g., the third example unit cell 128*a*) or in the nighttime heat mode (e.g., the fourth example unit cell 128*b*). That is, regardless of the position of the unit cell 128*a*, 128*b* or the substrate 102 (i.e., in the daytime heat mode or the nighttime heat mode), the example nanoparticle deposits 130*a*-130*c* are stationary and do not move or shift with the expansion and contraction of the substrate 102. It should be also understood that, in some embodiments, the example nanoparticle deposits 130*a*-130*c* may pivot, change orientations, and the like while maintaining the gaps or distance between adjacent particles. As such, the example nanoparticle deposits 130*a*-130*c* maintain the periodic pattern regardless of the mode. In other embodiments, the example nanoparticle deposits 130*a*-130*c* are stationary regardless of movement of the substrate 102.

Similar to the unit cell 126*b* (FIGS. 4A-4B) discussed above, in some embodiments, in the nighttime heat mode, the fourth example unit cell 128*b* is expanded in the system longitudinal direction (i.e., in the +/−X direction), in the system lateral direction (i.e., in the +/−Y direction), and/or in combinations thereof. In contrast, in the daytime heat mode, the third example unit cell 128*a* is contracted in the system longitudinal direction (i.e., in the +/−X direction), in the system lateral direction (i.e., in the +/−Y direction), and/or in combinations thereof.

Referring to FIGS. 1-5, in some embodiments, the example optical metamaterials system 100 is used to provide radiative cooling. However, this is non-limiting and the example optical metamaterials system 100 may be used in a plurality of various applications. For example, the example optical metamaterials system 100 may be configured as a light sail for a space application where the example optical metamaterials system 100 beams energy in a radiative method to selectively actuate different portions of a sheet and spatial properties. In other applications, the example optical metamaterials system 100 may be used to control the amount of light through an object, such as a windshield or glass, to trigger light sources based on a determined amount of ambient light, and the like.

Figure 6:
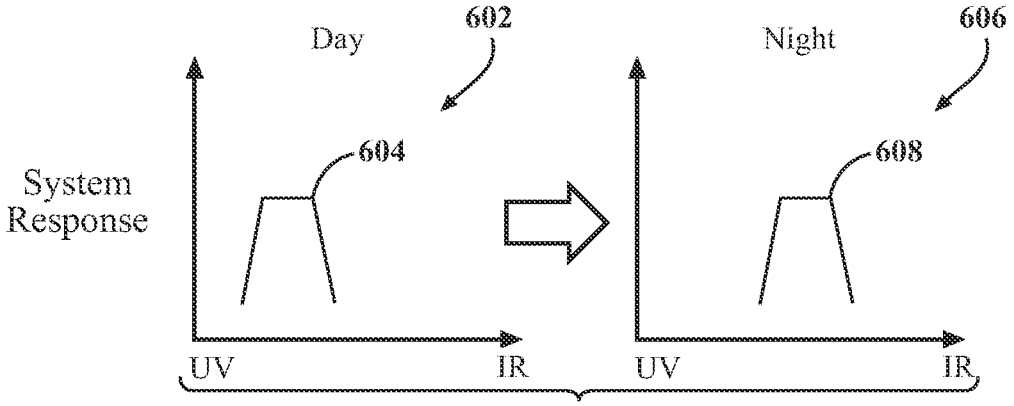
FIG. 6 schematically depicts a graphical representation of a system response between the daytime heat mode and the nighttime heat mode according to one or more embodiments shown and described herein.

Now referring to FIG. 6, a graphical representation of example optical metamaterials system 100 response to a determined daytime heat mode and nighttime heat mode is schematically depicted. As illustrated, when a daytime heat mode is activated 602, the example optical metamaterials system 100 (FIG. 1) is shifted towards an ultraviolet (UV) spectrum 604. Conversely, when a nighttime heat mode is activated 606, the example optical metamaterials system 100 (FIG. 1) is shifted towards an infrared (IR) spectrum 608. That is, nighttime ambient electromagnetic radiation generally has longer average wavelength than does daytime ambient electromagnetic radiation. The shift of the absorption/emission band spectrum allows the radiative cooling assembly 101 (FIG. 1) to be tuned for radiative cooling of daytime vs. nighttime heat. For example, the substrate 102 (FIG. 1) may be stretched, expanded, elongated, or the like at nighttime to switch the cooling structure to night heat mode, in which it is better tuned to the ambient wavelengths dominant during the night. It should be appreciated that this may be accomplished progressively, or in a single step. As discussed herein, the substrate 102 (FIG. 2) is electroactive to cause the stretching, expanding, elongating, and the like, of the substrate 102 (FIG. 1).

It should be understood that the shifting of the systems response is achieved through the manipulating of the substrate 102 (FIG. 1), the plurality of unit cells 114 (FIG. 1), the optical properties of the plurality of nanoparticles 112 (FIG. 1), and the like.

Figure 7:
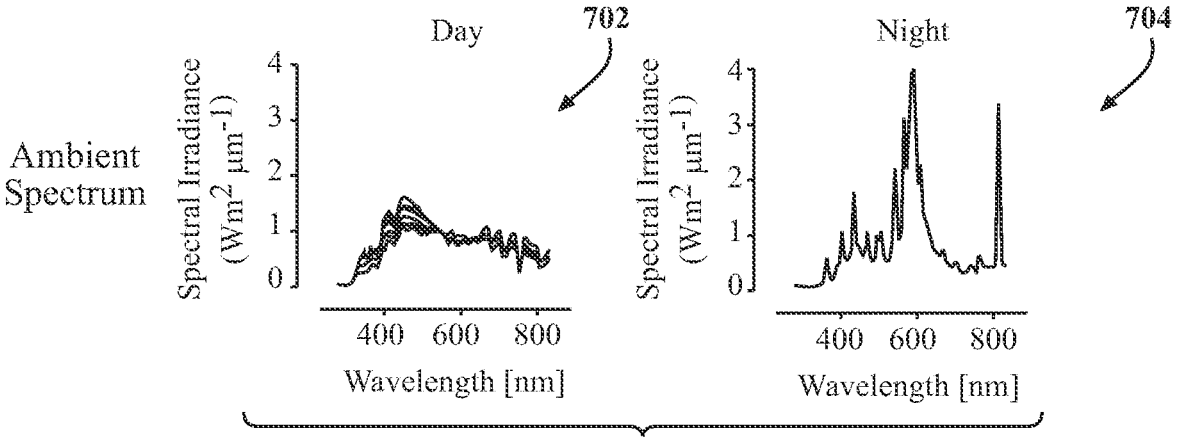
FIG. 7 schematically depicts a graphical representation of an ambient spectrum of daytime solar irradiance and the nighttime solar irradiance according to one or more embodiments shown and described herein.

Now referring to FIG. 7, a graphical representation of the ambient spectrum is schematically depicted. It should be understood that the wavelength is used as the spectral variable. The ambient spectrum for daytime 702 has a peak of less than 2 $Wm^2\ \mu m^{-1}$ in the spectral irradiance, or radiant flux, and is generally uniform between the 400-800 nm wavelength. The ambient spectrum for the nighttime 704 has a peak of approximately 4 $Wm^2\ \mu m^{-1}$ in the spectral irradiance, or radiant flux, and is generally irregular between the 400-800 nm wavelength. As such, there are significant differences in the spectral irradiance between daytime and nighttime. The spectrum tends to shift to the IR in the nighttime 704 compared to the daytime 702, which tends to be closer to the UV. As such, the control unit 122 (FIG. 1) is configured to determine the time of day, the solar spectral irradiance, and the like, such that the example optical metamaterials system 100 (FIG. 1) may have efficient tunable radiative cooling dependent on the dominating wavelength that corresponds to the time of day.

Figure 8:
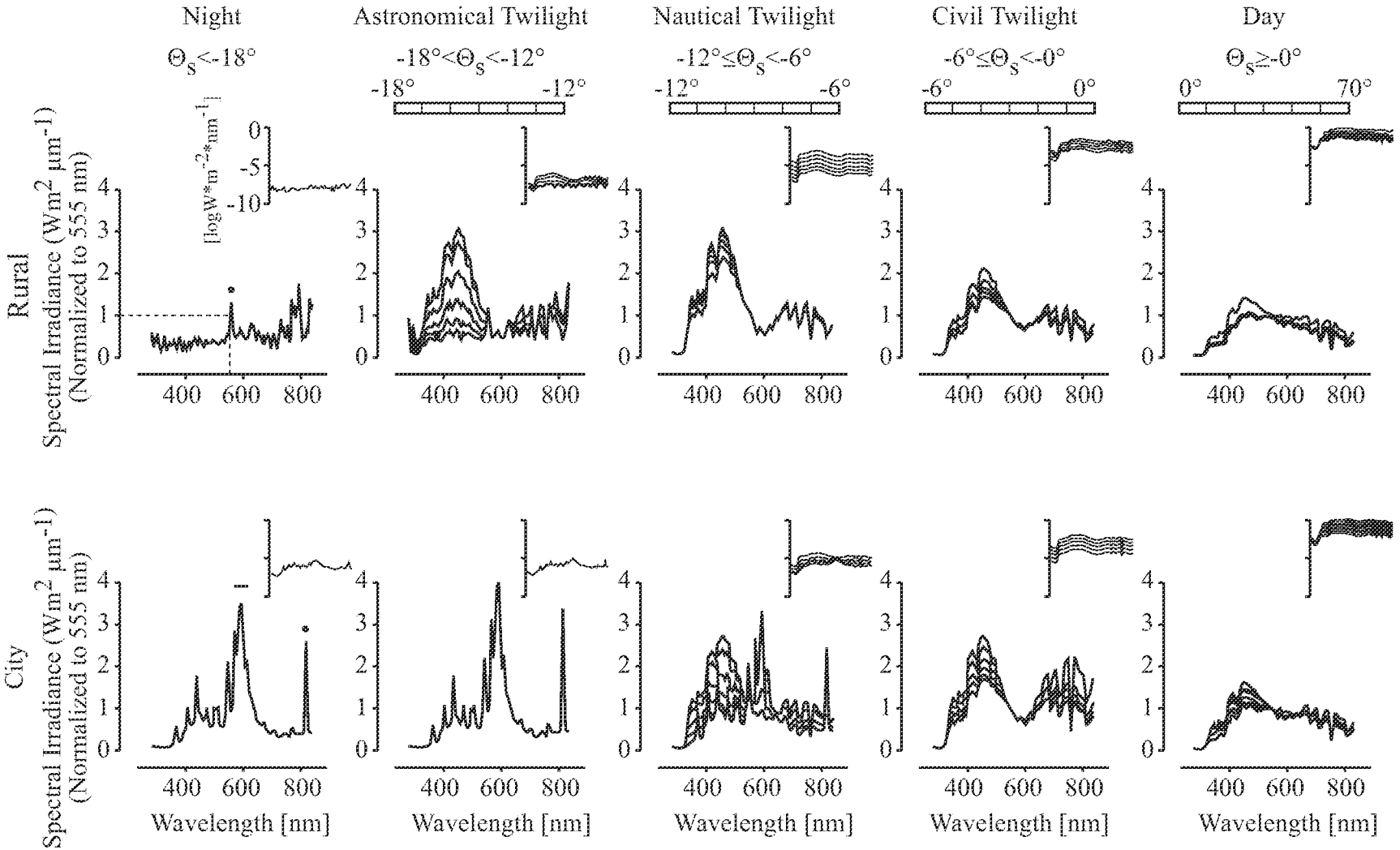
FIG. 8 schematically depicts a graphical representation of a spectral solar irradiance for various times of a day according to one or more embodiments shown and described herein.

Further, the solar irradiance may be determined based on the time of day, whether the environment is rural or city, and may be normalized based on a distance from and facing the source, as illustrated in FIG. 8. That is, FIG. 8 is a graphical representation of example solar irradiance for varying times of the day. FIG. 8 illustrates the expected dominate wavelengths based on a solar elevation and the current environment. As such, FIG. 8 is to be understood as merely illustrating a correlation between solar irradiance, the UV and IR spectrums and the solar elevation.

The bars above each plot indicate the solar elevation and theta (θ) is the degrees of the solar elevation. As illustrated, the spectrum tends to shift more significantly to the IR spectrum in the night for cities when compared to rural areas. Further, the spectrum tends to shift and tends to shift more significantly to the IR spectrum in the twilight for cities when compared to rural. In a non-limiting example, the color of the sky is blue during the day, but the color of the sky changes to red over time during twilight, which produces longer wavelengths.

It should be appreciated that, based on the simulations in FIG. 8, the example optical metamaterials system 100 (FIG. 1) may be tuned by expanding or stretching the substrate 102 (FIG. 1) and thus changing the optical properties for the plurality of nanoparticles 112 (FIG. 1). As such, because the spectrum appears to remain stable and generally equal between the city and rural in the daytime, the example optical metamaterials system 100 may be tuned to the UV spectrum during these solar elevations and environments. Conversely, because the spectrum appears to shift to the IR spectrum in the twilight and nighttime for cities, the example optical metamaterials system 100 may be tuned to the IR spectrum during these solar elevations and environments.

Figure 9:
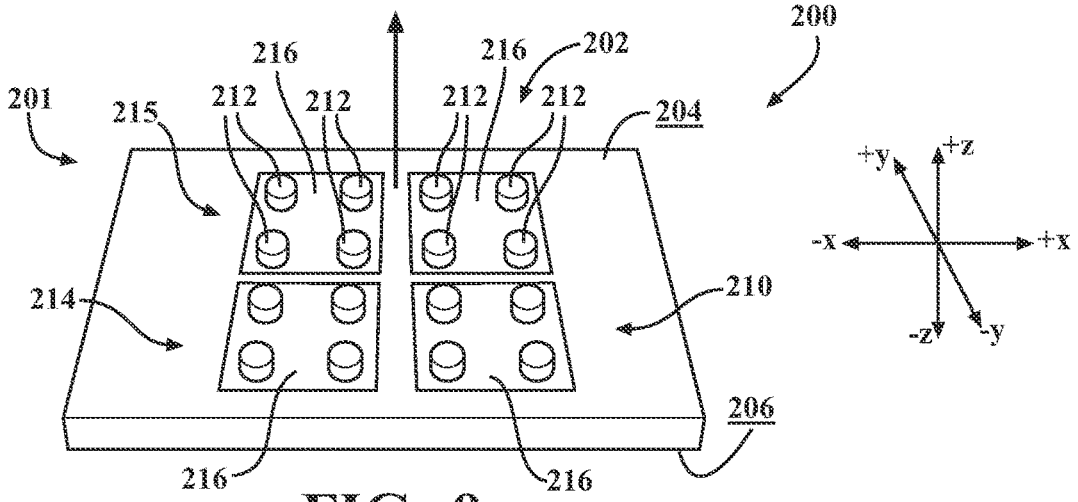
FIG. 9 schematically depicts an isolated perspective view of a second example optical metamaterials system with a plurality of unit cells disposed on a substrate of an assembly in a daytime heat mode according to one or more embodiments shown and described herein.
Figure 10:
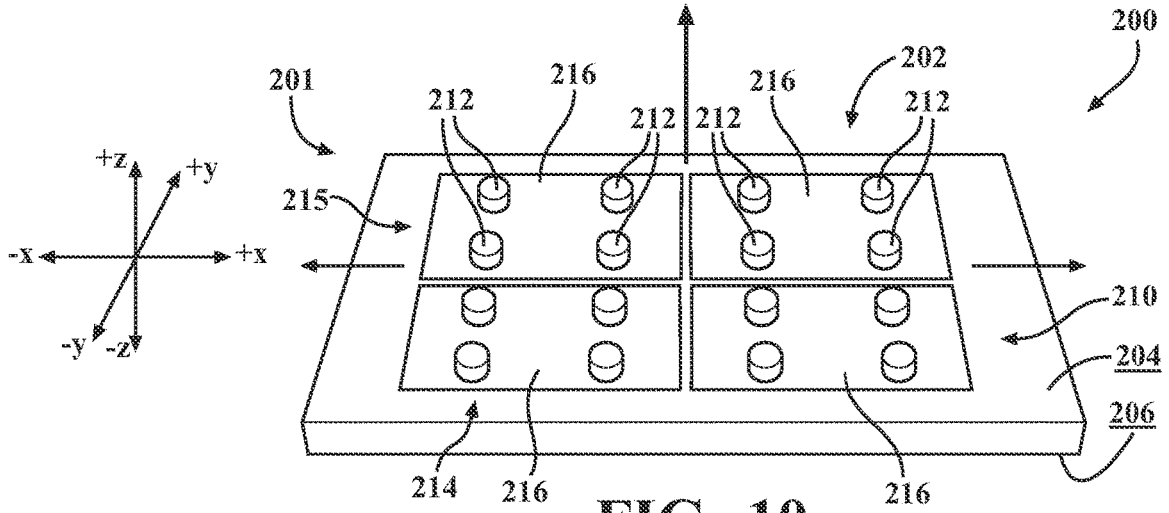
FIG. 10 schematically depicts an isolated perspective view of the assembly of the second example optical metamaterials system of FIG. 9 in a nighttime heat mode according to one or more embodiments shown and described herein.
Figure 11:
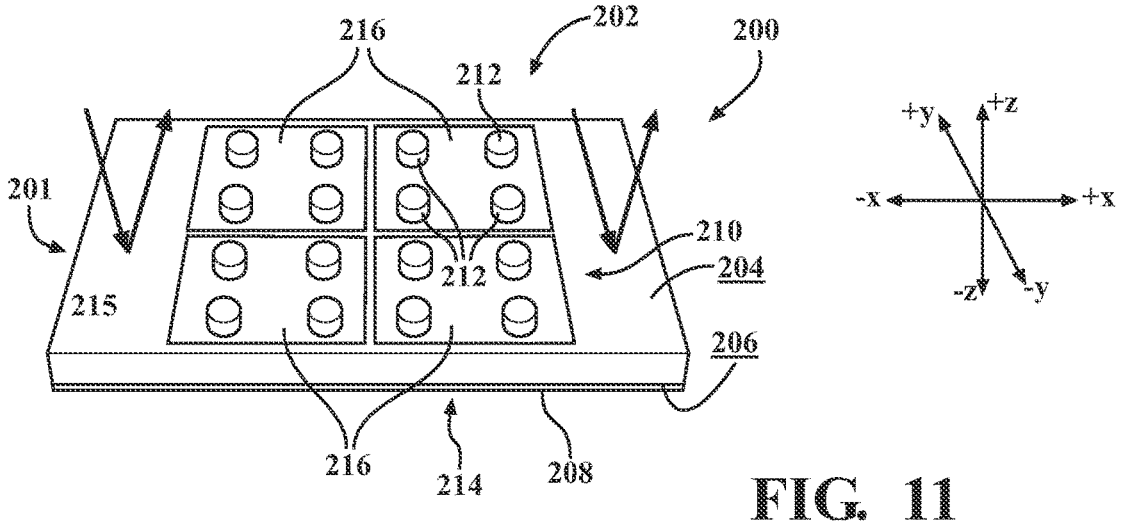
FIG. 11 schematically depicts an isolated perspective view of the assembly of the second example optical metamaterials system of FIG. 9 with a backing coupled to the substrate according to one or more embodiments shown and described herein.

Referring now to FIGS. 9-11, a second aspect of a substrate 202 is schematically depicted. The substrate 202 may be similar to the substrate 102 (FIG. 1) with the exceptions of the features described herein. As such, like features will use the same reference numerals with a prefix "2" for the reference numbers. As such, for brevity reasons, these features will not be described again.

An optically active array 210 is disposed or deposited on the upper surface 204 of the substrate 202. That is, the optically active array 210 is deposited to be in physical communication with the substrate 202. The optically active array 210 extends from the upper surface 204 in the system vertical direction (i.e., in the +/−Z direction). That is, the optically active array 210 extends from the upper surface 204 of the substrate 202 in a direction opposite of the inner surface 206. The optically active array 210 is repeating across the upper surface 204 of the substrate 202. In some embodiments, the optically active array 210 periodic, or in a uniform pattern. In other embodiments, the optically active array 210 is aperiodic, or in a random non-uniform sequence. Further, the optically active array 210 may be deposited into a plurality of independent uniform patterns, into a plurality of independent non-uniform patterns, combinations thereof, and the like.

The optically active array 210 includes an array 215 of a plurality of nanoparticles 212 or resonators positioned within individual unit cells 216. The individual unit cells 216 form a plurality of unit cells 214. Example particles of the plurality of nanoparticles 212 or resonators include metals, such as gold, semiconductors, or ceramics, such as titanium nitrate. The array 215 of the plurality of nanoparticles 212 or resonators is configured to plasmonically absorb and emit infrared (IR) radiation. As such, the absorption/emission band of the optically active array 210 is dictated, at least in part, by the periodicity of the plurality of nanoparticles 212 or resonators. As such, as the periodicity of the optically active array 210 is altered by expansion and/or contraction of the substrate 202, which is tuning the absorption/emission band, as discussed in greater detail herein. As such, the array 215 of the plurality of nanoparticles 212 or resonators is effective to absorb and re-emit locally originated IR radiation.

The example particles of the plurality of nanoparticles 212 or resonators may be contained in the individual unit cell 216, forming a plurality of unit cells 214 that are each positioned on the upper surface 104 or extend from the upper surface 104. That is, at least one nanoparticle of the plurality of nanoparticles 212 or resonators of the optically active array 210 may be contained in its own unit cell 216. It should be appreciated that, in some embodiments, the unit cell 216 includes only a single particle of the plurality of nanoparticles 212 or resonators. In other embodiments, the unit cell 216 includes more than one particle of the plurality of nanoparticles 212 or resonators. It should be understood that the plurality of nanoparticles 212 or resonators of the optically active array 210 may be the example nanoparticle deposits 112*a*-112*d* of FIG. 4A, the example nanoparticle deposits 124*a*-124*d* of FIG. 4A or the example nanoparticle deposits 130*a*-130*c* of FIG. 5.

It should also be appreciated that the plurality of unit cells 214 that include the plurality of nanoparticles 212 form a pattern of the optically active array 210. In some embodiments, the pattern of the plurality of unit cells 214 is periodic, or a uniform pattern. In other embodiments, the pattern of the plurality of unit cells 114 is aperiodic, or random.

The optically active array 210 that includes the plurality of nanoparticles 212 or resonators positioned within individual unit cells 216 of the plurality of unit cells 214 is deposited onto the upper surface 204 of the substrate 202 via lithography. In some embodiments, the lithography is an electron beam lithography. In other embodiments, the lithography is a photolithography, an optical lithography, a UV lithography, and/or the like. As such, the optically active array 210 is an additional layer positioned on the upper surface 204 of the substrate 202 and extends from the upper surface 204 in the system vertical direction (i.e., in the +/−Z direction).

Figure 12:
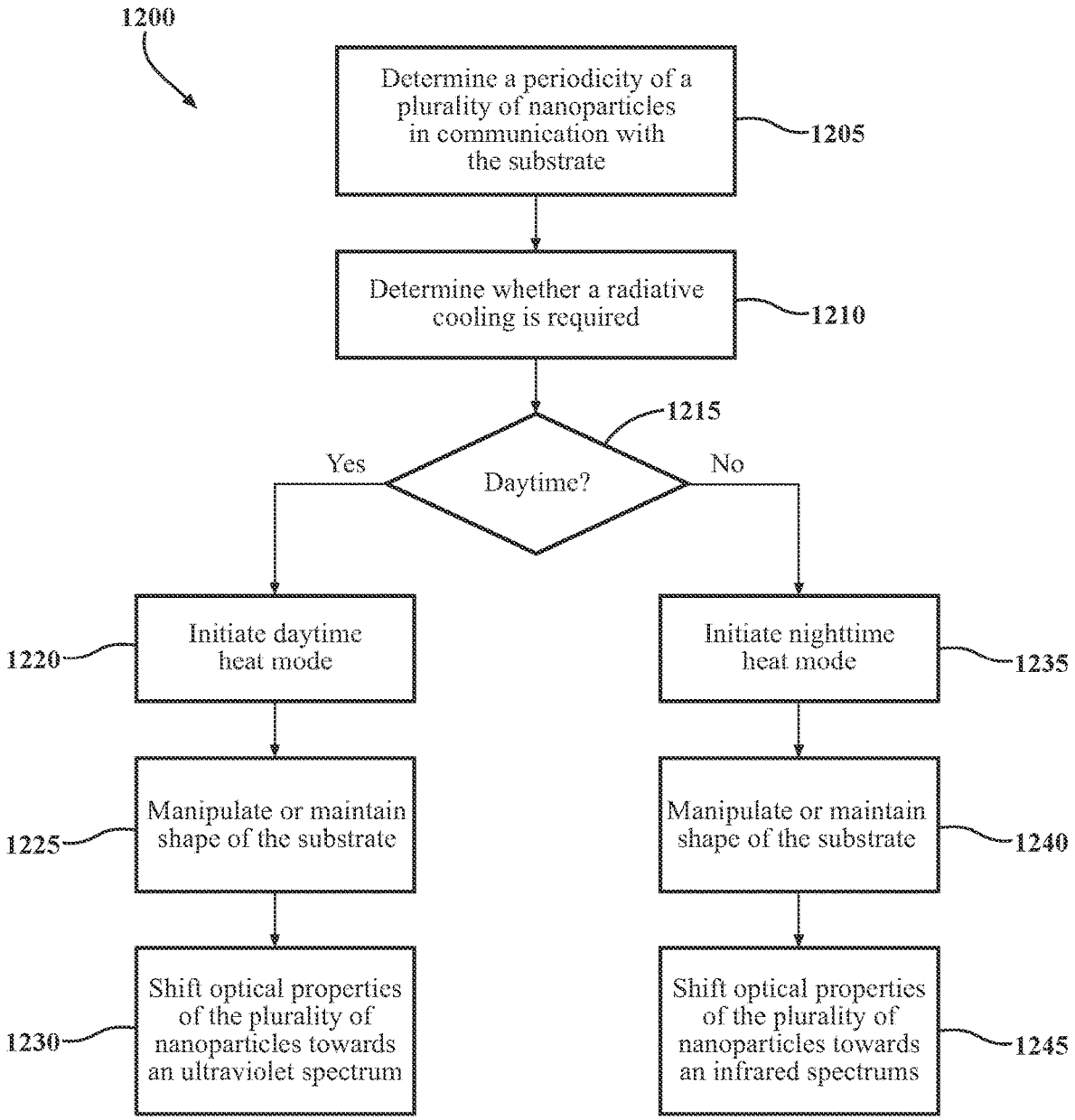
FIG. 12 schematically depicts an illustrative method of initiating a daytime heat mode and a nighttime heat mode according to one or more embodiments shown and described herein.

FIG. 12 is a flow diagram that graphically depicts an illustrative method 1200 initiating a daytime heat mode or a nighttime heat mode is provided. Although the steps associated with the blocks of FIG. 12 will be described as being separate tasks, in other embodiments, the blocks may be combined or omitted. Further, while the steps associated with the blocks of FIG. 12 will described as being performed in a particular order, in other embodiments, the steps may be performed in a different order.

At block 1205, the example optical metamaterials system determines a periodicity of the plurality of nanoparticles in communication with the electroactive substrate. It should be understood that periodicity of the plurality of nanoparticles of the electroactive substrate may be based on the type of nanoparticle, whether the nanoparticle shifts or moves with the substrate, whether the nanoparticle is embedded within the substrate or deposited on the upper surface of the substrate, the pattern of the unit cells, and the like. At block 1210, the example optical metamaterials system determines whether a radiative cooling is required and, at block 1215, whether it is daytime.

If the example optical metamaterials system determines that it is daytime, or in the alternative, any time other than nighttime, the example optical metamaterials system initiates the unactuated or daytime heat mode, at block 1220. As such, the control unit and electric source either manipulates the shape of the substrate to the unactuated state or home position, if not already in this position, and/or maintains the unactuated or home position of the substrate, at block 1225. As such, at block 1230, the optical properties of the plurality of nanoparticles are shifted towards the UV spectrum.

On the other hand, if the example optical metamaterials system determines that it is not daytime, the example optical metamaterials system initiates the actuated or nighttime heat mode, at block 1235. As such, the control unit and electric source either manipulates the shape of the substrate into the actuated state or expanded position, if not already in this position, and/or maintains the actuated or expanded position of the substrate, at block 1240. As such, at block 1230, the optical properties of the plurality of nanoparticles are shifted towards the IR spectrum.

It should be appreciated that the illustrative method 1200 may continuous be executed and continuously loop such that the example optical metamaterials system is continuous tunable between different modes based on the time of day, the environment, and solar irradiance, and the like.

It should now be understood that the embodiments of this disclosure described herein provide a system for radiative cooling that is adjustable to changing wavelengths (i.e., dominant radiative wavelengths in daytime vs. nighttime). The system utilizes electroactive substrates for controlling nano and/or micro expansion or stretching of the substrate for on-demand tunable radiative cooling. More particularly, the substrate is manipulated between a daytime heat mode and a nighttime heat mode, via an electric source, to change the absorption band or the emission band of the plurality of nanoparticles to tune the optical metamaterials system for radiative cooling. As such, the shape changes of the electroactive substrate generates or causes a resonance shift of the optical properties of the plurality of nanoparticles of the optical metamaterials system towards an infrared spectrum or towards an ultraviolet spectrum.

It is noted that the term "about" and "generally" may be utilized herein to represent the inherent degree of uncertainty that may be attributed to any quantitative comparison, value, measurement, or other representation. This term is also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A system comprising:

an electroactive substrate;

a plurality of nanoparticles deposited in communication with the electroactive substrate; and a processor configured to manipulate a shape of the electroactive substrate between a unactuated mode and an actuated mode to change an absorption band or an emission band of the plurality of nanoparticles, wherein when the electroactive substrate shape is manipulated, the absorption band or the emission band of the plurality of nanoparticles is changed to tune the system for a radiative cooling based on a current dominating wavelength.

2. The system of claim 1, further comprising:

an electric source communicatively coupled to the electroactive substrate, wherein in the actuated mode, the electric source supplies a current to the electroactive substrate to expand the shape of the electroactive substrate to cause a resonance shift of optical properties of the plurality of nanoparticles towards an infrared spectrum.

3. The system of claim 2, wherein the electroactive substrate expands in a system lateral direction, in a system longitudinal direction, or in a combination thereof.

4. The system of claim 2, wherein the electric source is communicatively coupled to the electroactive substrate via a plurality of electrical conductors attached at varying points.

5. The system of claim 2, wherein in the unactuated mode, the electric source reduces the current supplied to the electroactive substrate to contract the shape of the electroactive substrate to cause the resonance shift of optical properties of the plurality of nanoparticles towards an ultraviolet spectrum.

6. The system of claim 5, wherein the electroactive substrate contracts in a system lateral direction, in a system longitudinal direction, or in a combination thereof.

7. The system of claim 1, further comprising:

a plurality of unit cells are positioned in communication with the electroactive substrate, each unit cell of the plurality of unit cells having at least one nanoparticle of the plurality of nanoparticles.

8. The system of claim 7, wherein:

the electroactive substrate has an upper surface and an opposite inner surface, the upper surface of the electroactive substrate is planar, and the electroactive substrate is a polymer material.

9. The system of claim 1, wherein the plurality of nanoparticles are a metal, a semiconductor, or a ceramic.

10. The system of claim 1, wherein the manipulation of the shape of the electroactive substrate changes a relative spacing of the plurality of nanoparticles that causes a shift in the absorption band or the emission band of the plurality of nanoparticles.

11. The system of claim 1, wherein the inner surface includes a backing that reflects a solar irradiance.

12. A method of controlling an optical metamaterials system, the method comprising:

determining, by a processor, a periodicity of a plurality of nanoparticles deposited in communication with an electroactive substrate;

determining, by the processor, whether a radiative cooling is required; and manipulating, via an electric source, a shape of the electroactive substrate between an unactuated mode and an actuated mode to tune the optical metamaterials system for radiative cooling, wherein the manipulating of the shape of the electroactive substrate changes the periodicity of the plurality of nanoparticles to change an absorption band or an emission band of the plurality of nanoparticles.

13. The method of claim 12, wherein the change in the absorption band or the emission band of the plurality of nanoparticles tunes the optical metamaterials system for radiative cooling.

14. The method of claim 12, wherein in the actuated mode, the electric source supplies a current to the electroactive substrate to expand the electroactive substrate to cause a shift in optical properties of the plurality of nanoparticles towards an infrared spectrum.

15. The method of claim 14, wherein in the unactuated mode, the electric source reduces the current supplied to the electroactive substrate to contract the electroactive substrate to cause the shift in optical properties of the plurality of nanoparticles towards an ultraviolet spectrum.

16. The method of claim 15, wherein the electroactive substrate expands and contracts in a system lateral direction, in a system longitudinal direction, or in a combination thereof.

17. The method of claim 12, wherein:

the electroactive substrate has an upper surface and an opposite inner surface, the upper surface of the electroactive substrate is planar, and the electroactive substrate is a polymer material.

18. The method of claim 12, wherein the plurality of nanoparticles are a metal, a semiconductor, or a ceramic.

19. An optical metamaterials system comprising:

an electroactive substrate having an upper surface and an inner surface, the upper surface of the electroactive substrate is planar;

a plurality of unit cells positioned in communication with the electroactive substrate, each unit cell of the plurality of unit cells having at least one nanoparticle deposit of a plurality of nanoparticles;

an electric source communicatively coupled to the electroactive substrate; and a processor configured to control the electric source to supply a voltage or a current to manipulate a shape of the electroactive substrate between an unactuated mode and an actuated mode to change an absorption band or an emission band of the plurality of nanoparticles, wherein:

in the actuated mode, the electric source supplies a current to the electroactive substrate to expand the electroactive substrate for each unit cell of the plurality of unit cells to cause a shift in optical properties of the plurality of nanoparticles towards an infrared spectrum and, in the unactuated mode, the electric source reduces the current supplied to the electroactive substrate to contract the electroactive substrate for each unit cell of the plurality of unit cells to cause the shift in optical properties of the plurality of nanoparticles towards an ultraviolet spectrum.

20. The optical metamaterials system of claim 19, wherein the change in the shape of the electroactive substrate changes the absorption band or the emission band of the plurality of nanoparticles to tune the optical metamaterials system for a radiative cooling based changing dominant wavelengths.

* * * * *